US006093117A

United States Patent [19]

Sherlock et al.

[11] Patent Number: 6,093,117

[45] Date of Patent: Jul. 25, 2000

[54] BALL PITCHING MACHINE

[75] Inventors: Sue M. Sherlock, Jefferson; Neal C. Squibb, Scranton, both of Iowa

[73] Assignee: American Sports International, Ltd., Jefferson, Iowa

[21] Appl. No.: 09/021,093

[22] Filed: Feb. 10, 1998

[51] Int. Cl.[7] ..... A63B 69/00

[52] U.S. Cl. ..... 473/422; 124/78

[58] Field of Search ..... 124/78, 49, 81, 124/80; 473/5, 422

[56] References Cited

U.S. PATENT DOCUMENTS

| | | | |
|---|---|---|---|
| Re. 30,703 | 8/1981 | Paulson | 124/81 |
| 3,018,769 | 1/1962 | Parsoneault | 124/81 |
| 3,538,900 | 11/1970 | Samuls | 124/78 |
| 3,794,011 | 2/1974 | Newgarden | 124/81 |
| 3,867,921 | 2/1975 | Politzer | 124/81 |
| 4,193,591 | 3/1980 | Paulson | 124/81 |
| 4,195,614 | 4/1980 | Ponza | 124/81 |
| 4,197,827 | 4/1980 | Smith | 124/81 |
| 4,423,717 | 1/1984 | Kahelin | 124/78 |
| 4,583,514 | 4/1986 | Nozato | 124/78 |
| 4,760,835 | 8/1988 | Paulson | 124/78 |
| 4,841,945 | 6/1989 | Braden | 124/78 |
| 5,012,790 | 5/1991 | Bates | 124/81 |
| 5,437,261 | 8/1995 | Paulson | 124/81 |

*Primary Examiner*—Sam Rimell

*Attorney, Agent, or Firm*—Zarley, McKee, Thomte, Voorhees & Sease

[57] ABSTRACT

A ball pitching machine includes a head assembly for ejecting a ball therefrom, operably mounted on a vertically extensible piston to permit selective vertical adjustment of the head assembly on a base assembly. The base assembly includes an upright tubular mast within which the piston is slidably journaled, the mast having a plurality of legs supporting the mast above the ground. A lock mechanism on the mast permits selective securement of the piston within the mast. The head assembly has a mounting bracket rotatably connected to the forward end of an elongated handle to permit selective rotation of the head assembly about the axis of the handle. The handle has a shaft rotatably mounted in a bracket on the upper end of the piston, permitting selective rotational movement of the handle about the shaft on the piston. The shaft on the handle is mounted orthogonal to the longitudinal axis of the handle and orthogonal to the axis of the piston, thereby permitting selective adjustable movement of the head assembly about three orthogonal axes. The head assembly includes first and second rotating pitching wheels mounted on coplanar support plates which are slidably mounted for selective movement towards and away from one another in the same plane, to permit selective adjustment of the space between the pitching wheels.

11 Claims, 5 Drawing Sheets

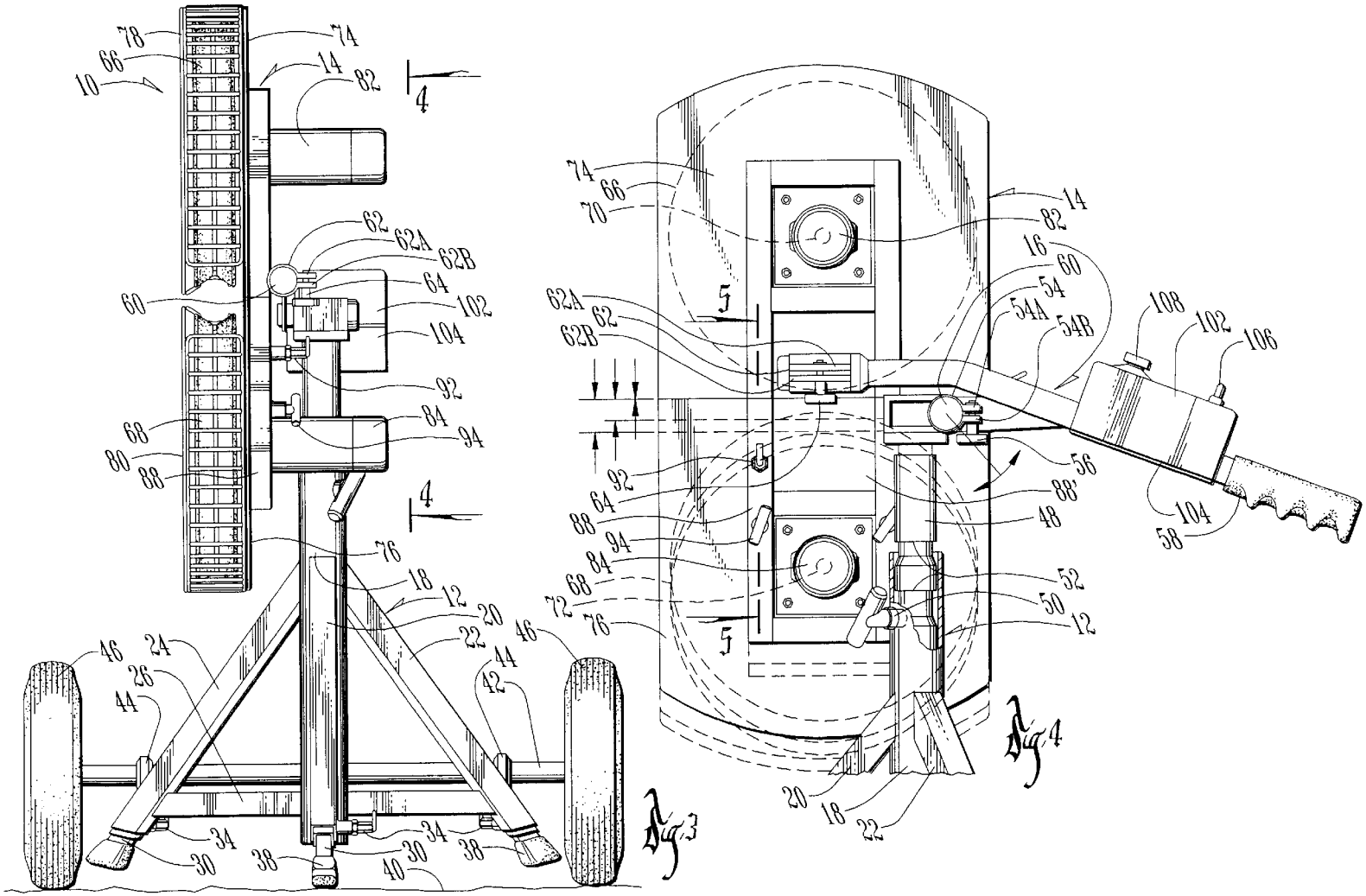

BALL PITCHING MACHINE

TECHNICAL FIELD

The present invention relates generally to apparatus for pitching baseballs and the like, and more particularly to an improved ball pitching machine adjustable for various size balls, and for universal and incremental adjustment along three axes for a pitched ball.

BACKGROUND OF THE INVENTION

Ball pitching machines have been utilized for many years in various sports, to assist a player in practicing in a particular sport. For example, a pitching machine is commonly utilized by batters to practice hitting various types of pitches in the sport of baseball.

One problem common to prior art pitching machines was the difficulty and complexity required to adjust the machine to pitch various types of pitches at various heights in goals of elevation and speed.

Another problem with prior art pitching machines was in the difficulty in adjusting the machine to various sizes of balls. This is particularly important, since kickback of a ball can seriously harm the person feeding the machine with balls.

SUMMARY OF THE INVENTION

It is therefore a general object of the present invention to provide an improved ball pitching machine.

A further object is to provide a ball pitching machine which permits vertical adjustment of the pitching heads without changing the angle of elevation or rotation of the pitching heads.

Another object of the present invention is to provide a pitching machine which quickly and easily adjusts to various ball sizes.

Still another object is to provide a pitching machine which is easily adjusted along a vertical axis and along its axis of elevation.

These and other objects of the present invention will be apparent to those skilled in the art.

The ball pitching machine of the present invention includes a head assembly for ejecting a ball therefrom, operably mounted on a vertically extensible piston to permit selective vertical adjustment of the head assembly on a base assembly. The base assembly includes an upright tubular mast within which the piston is slidably journaled, the mast having a plurality of legs supporting the mast above the ground. A lock mechanism on the mast permits selective securement of the piston within the mast. The head assembly has a mounting bracket rotatably connected to the forward end of an elongated handle to permit selective rotation of the head assembly about the axis of the handle. The handle has a shaft rotatably mounted in a bracket on the upper end of the piston, permitting selective rotational movement of the handle about the shaft on the piston. The shaft on the handle is mounted orthogonal to the longitudinal axis of the handle and orthogonal to the axis of the piston, thereby permitting selective adjustable movement of the head assembly about three orthogonal axes. The head assembly includes first and second rotating pitching wheels mounted on coplanar support plates which are slidably mounted for selective movement towards and away from one another in the same plane, to permit selective adjustment of the space between the pitching wheels.

BRIEF DESCRIPTION OF THE DRAWINGS

FIG. 3 is a front elevational view of the pitching machine in the orientation of FIG. 2;

FIG. 4 is an enlarged elevational view taken at lines 4—4 in FIG. 3;

DESCRIPTION OF THE PREFERRED EMBODIMENT

Figure 1:
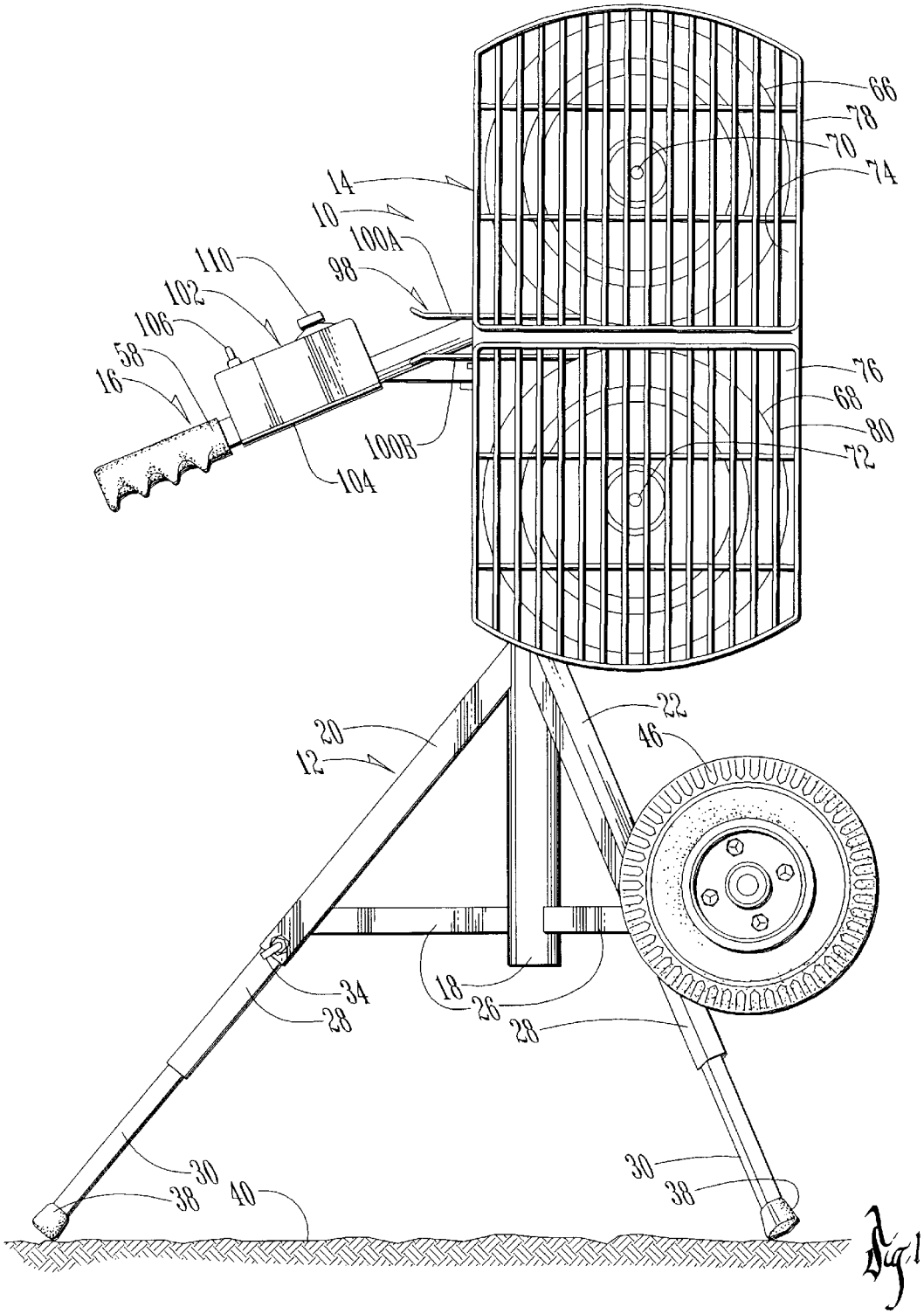
FIG. 1 is a side elevational view of the ball pitching machine showing the machine in a raised vertical orientation.

Referring now to the drawings, in which similar or corresponding parts are identified with the same reference numeral, and more particularly to FIG. 1, the ball pitching machine of the present invention is designated generally at 10 and including a base assembly 12 supporting an adjustable head assembly 14 and a handle assembly 16 above the ground.

Base assembly 12 includes a vertical tubular support mast 18 with a plurality of support legs 20, 22, and 24 (leg 24 shown more clearly in FIG. 3) extending radially outwardly and downwardly from the upper end of mast 18, to support mast 18 above the ground. For ease of description, support leg 20 will be referred to as the forward leg, while legs 22 and 24 will be referred to as rearward right and left legs respectively. Cross bracing 26 extends radially outwardly from mast 18 to a lower end of legs 20, 22, and 24, to securely attach the legs in a rigid frame.

Figure 7:
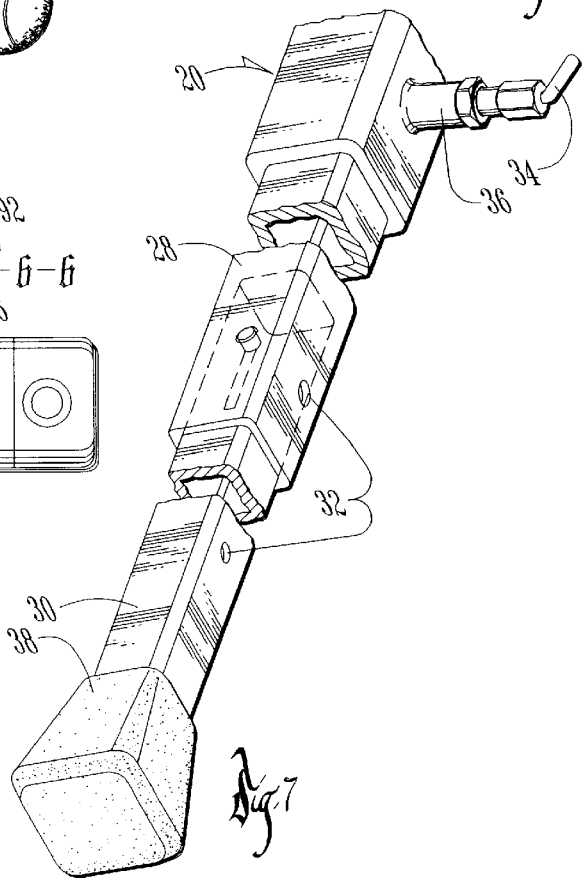
FIG. 7 is an enlarged perspective view of one leg of the pitching machine, showing the adjustment mechanism.

Each of legs 20, 22, and 24 includes an extensible intermediate leg 28 and an extensible lower leg 30, telescopically journaled within the lower end of each leg. The lower end of forward leg 20 is shown in more detail in FIG. 7. It can be seen that both the intermediate leg 28 and lower leg 30 include apertures 32 which may be selectively aligned with an operable locking pin 34 to selectively extend or retract the intermediate leg 28 and lower leg 30. Locking pin 34 is spring loaded through a collar 36 to bias the pin 34 into locking engagement with one of apertures 32. A molded tip 38 is mounted on the lower end of lower leg 30 to provide secure engagement with a ground surface.

Figure 2:
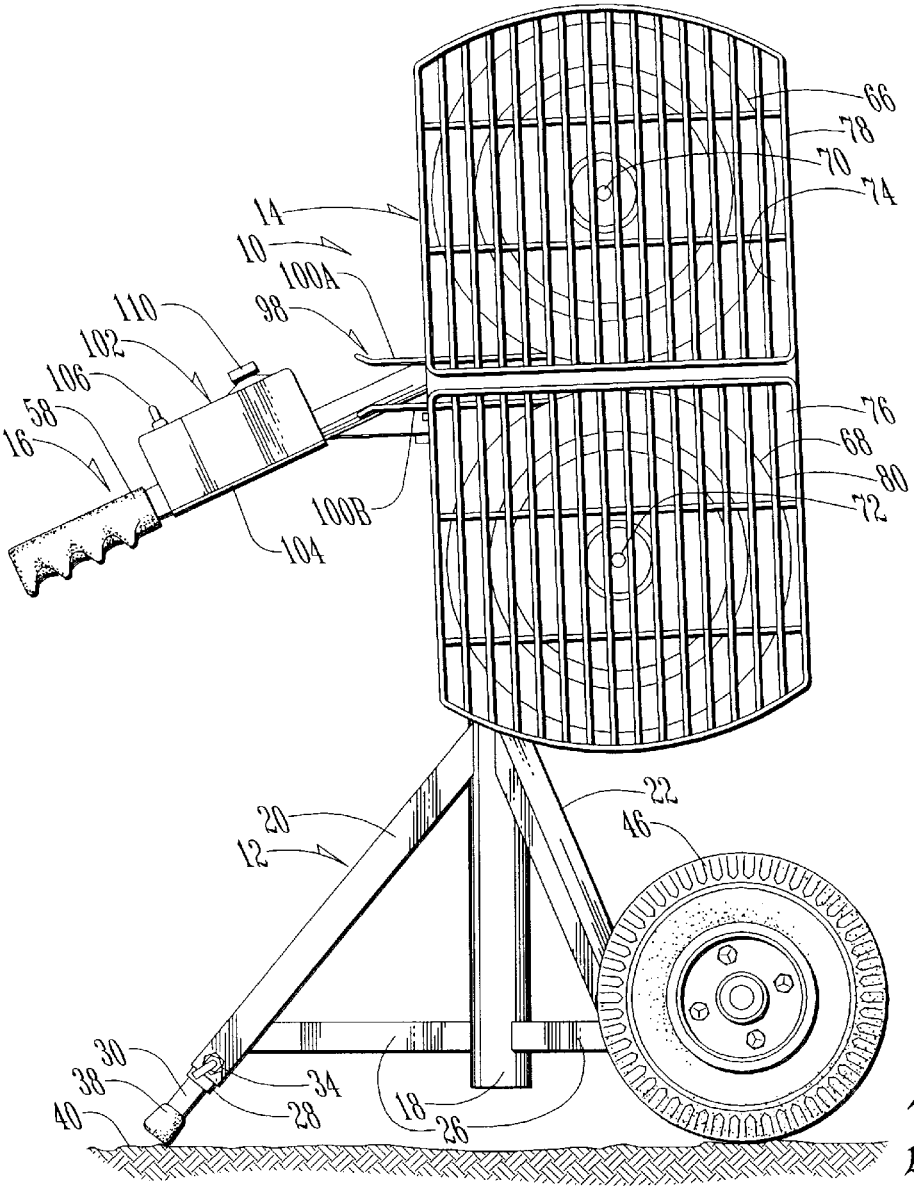
FIG. 2 is a side elevational view similar to FIG. 1, showing the machine in a lowered vertical orientation.

As shown in FIGS. 1 and 2, intermediate and lower legs 28 and 30 may be selectively retracted from the extended position shown in FIG. 1 to a retracted position shown in FIG. 2. This permits vertical adjustment of mast 18 relative to the ground surface 40, and transforms the base assembly from a supporting tripod (shown in FIG. 1), to a transport position (shown in FIG. 2).

Figure 10:
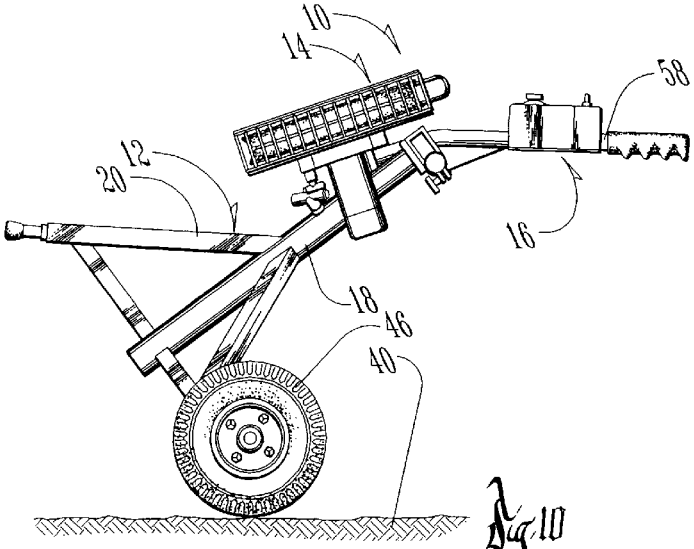
FIG. 10 is a side elevational view of the pitching machine, showing the transport position of the machine.

Referring to FIG. 3, an axle 42 is rotatably mounted through bearings 44 on rearward legs 22 and 24, and have wheels 46 mounted at the opposing ends thereof. Wheels 46 permit the ball pitching machine 10 to be easily transported, as shown in FIG. 10, by tipping the ball pitching machine 10 rearwardly onto wheels 46 with forward leg 20 projecting upwardly into the air.

The upper end of mast 18 is shown in more detail in FIGS. 3 and 4. A piston 48 is slidably received within the upper end of tubular mast 18. A locking device 50 is operably mounted on mast 18, to selectively lock piston 48 in various positions in its slidable movement. Locking device 10 is of a conventional variety having a shaft journaled through an aperture in mast 18 so as to engage piston 48 and retain the piston in a selected position. Preferably, piston 48 is provided with a plurality of vertically spaced shoulders 52 which will engage the shaft of the locking device to permit incremental vertical adjustment of piston 48 into an out of mast 18.

The upper end of piston 48 has a mounting bracket 54 affixed to its upper end, mounting bracket 54 having a pair of spaced apart jaws 54*a* and 54*b* which may be selectively drawn towards one another by an adjustment knob 56, to form an operable clamp. An elongated cylindrical handle 58 has a shaft 60 projecting orthogonally therefrom between jaws 54*a* and 54*b* of mounting bracket 54. In this way, loosening knob 56 permits handle 58 to be pivoted about the axis of shaft 60, and then held in position by tightening knob 56. Shaft 60 is also oriented orthogonal to the longitudinal axis of piston 48, to provide adjustable movement of the head assembly 14 on handle 58 about the horizontal axis of shaft 60.

A second mounting bracket 62 has jaws 62*a* and 62*b* selectively clamped around the forward end of handle 58, to permit selective rotational movement of the bracket 62 on the longitudinal axis of the forward end of handle 58 by selectively loosening and tightening securement knob 64 on jaws 62*a* and 62*b*. Thus, head assembly 14 is also adjustable about a third orthogonal axis (the longitudinal axis of the forward end of handle 58).

Referring to FIG. 2, head assembly 14 can be seen to include upper and lower pitching wheels 66 and 68 mounted on drive shafts 70 and 72 respectively, for rotation on drive shafts 70 and 72. Pitching wheels 66 and 68, and their associated drive shafts 70 and 72 are rotatably mounted on upper and lower support plates 74 and 76. Upper and lower shrouds 78 and 80 are mounted to the upper and lower support plates 74 and 76, and substantially encase pitching wheels 66 and 68. FIG. 3 shows the forward edge of shrouds 78 and 80, and discloses the fact that the shrouds have openings formed therein to permit a ball to be ejected from between the pitching wheels 66 and 68.

As shown in FIG. 4, drive shafts 70 and 72 are connected to upper and lower motors 82 and 84, which are fastened to the rearward face of upper and lower support plates 74 and 76.

Figure 5:
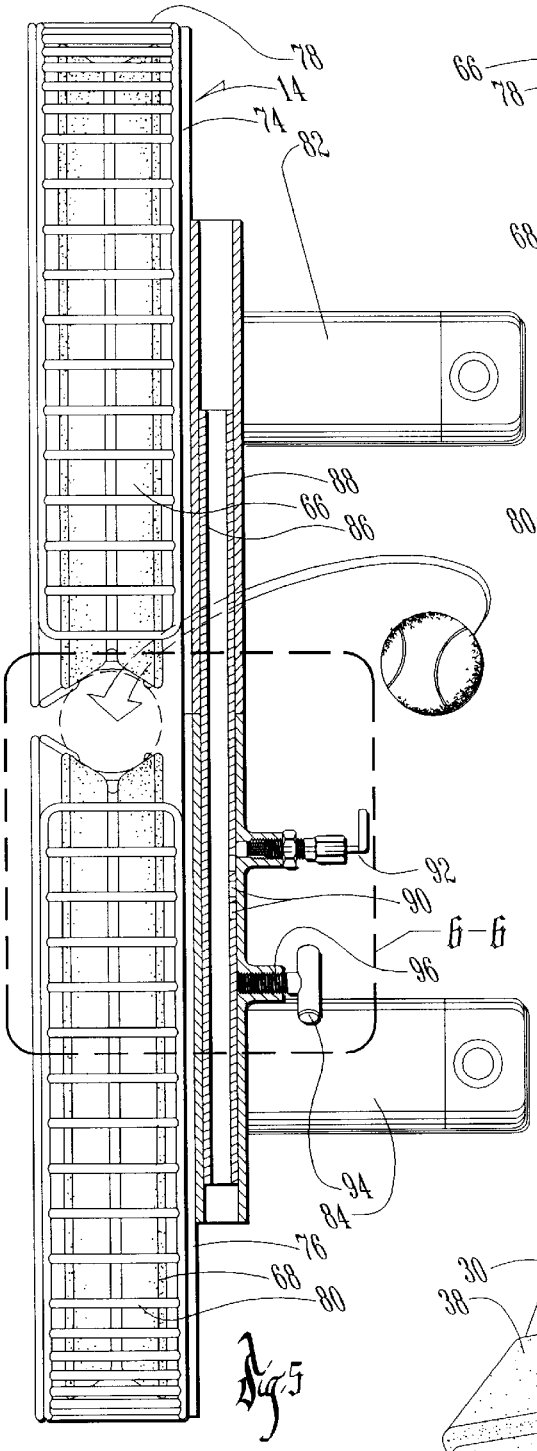
FIG. 5 is an enlarged elevational view taken at lines 5—5 in FIG. 4.

Referring now to FIG. 5, a pair of support plate 74 has a shaft 86 mounted on its rearward surface and extending downwardly beyond the lower edge of support plate 74. Lower support plate 76 has a tubular sleeve 88 aligned with shaft 86, for slidably receiving the lower end of shaft 86. A plurality of lined apertures 90 in the side of shaft 86 will receive a spring loaded pin 92 to secure shaft 86 relative to sleeve 88. A locking device 94 having a threaded shaft 96 will selectively engage the side of shaft 86 through a threaded aperture in sleeve 88, so as to secure shaft 86 within sleeve 88.

Figure 6:
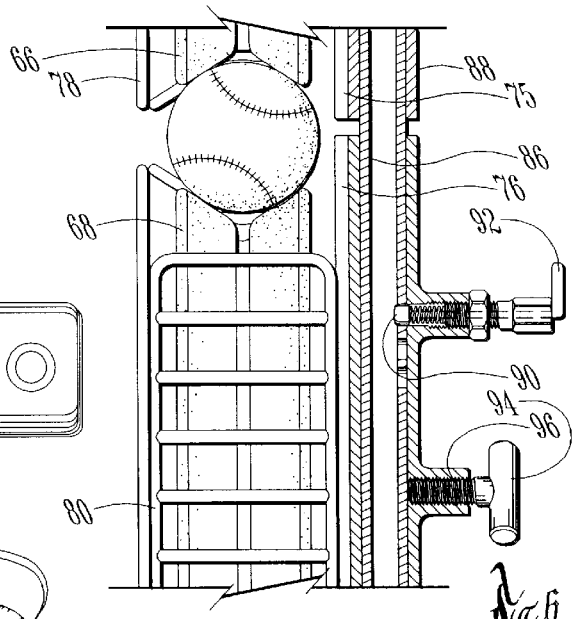
FIG. 6 is a super enlarged elevational view taken from the portion outlined in FIG. 5 at lines 6—6.

FIGS. 5 and 6 demonstrate the adjustment of the upper and lower pitching wheels 66 and 68 relative to one another, so as to permit adjustment for various sizes of balls. FIG. 5 shows shaft 86 extending downwardly into sleeve 88 to its fullest extent, such that upper support plate 74 is in contact with lower support plate 76. In this position, upper and lower pitching wheels 66 and 68 are mounted at the closest distance to one another, to receive the smallest diameter ball. FIG. 6 shows locking pin 92 in engagement with the first aperture 90 in shaft 86, thereby securing upper support plate 74 spaced slightly above lower support plate 76, and thereby permitting a larger diameter ball to be engaged by pitching wheels 66 and 68.

Referring once again to FIG. 4, it can be seen that upper support plate 74 is provided with a pair of parallel shafts which project downwardly into a pair of parallel sleeves 88 and 88'. These parallel sleeves assure correct alignment of upper and lower pitching wheels 66 and 68 as they are moved relative to one another to the broken line positions shown in FIG. 4.

It can be seen in FIG. 3 and 4 that second bracket 62 is secured to the upper support plate 74 of head assembly 14, thereby permitting rotation of the entire head assembly 14 about the longitudinal axis of the forward end of handle 58.

A ball feeder tube is designated generally at 98 and is formed by an upper U-shaped member 100*a* with its legs attached to upper shroud 78, and a lower U-shaped member 100*b* attached to lower shroud 80. The legs of U-shaped members 100*a* and 100*b* are parallel to one another, and spaced apart a distance less than the diameter of the smallest ball which can be pitched by the pitching machine 10. Ball feeder tube 98 has its upper and lower members 100*a* and 100*b* mounted on shrouds 78 and 80 a distance which will prevent a consumer from inserting a ball which is too large between the pitching wheels 66 and 68.

A control box 102 is mounted on a support plate 104 extending from handle 58. Control box 102 includes an on/off switch 106 and a pair of motor control knobs 108 and 110 (control knob 108 being shown in FIG. 4). Control box 102 electrically connects motors 82 and 84 (shown in FIG. 4) to a power supply (not shown), so as to selectively operate motors 82 and 84, thereby rotating pitching wheel 66 and 68, and ejecting a ball from the pitching wheels. Control knobs 108 and 110 independently control the speed of motors 82 and 84 such that pitching wheel 66 and 68 may rotate at different speeds. This in turn imparts a rotation on the pitched ball (for curved balls, sliders, and the like). On/off switch 106 is a master switch which connects and disconnects power from the motors.

In operation, ball pitching machine 10 may be easily transported by tipping the machine back on wheels 46 and pulling the cart by handle 58, as shown in FIG. 10. Once the pitching machine has been located where desired, the machine is tipped upright until forward leg 20 contacts the ground surface 40. Knob 56 on mounting bracket 54 may then be loosened to permit handle 58 to pivot on shaft 60, and thereby swing head assembly 14 from a downwardly candid position to a generally horizontal position. Knob 56 is then tightened to secure handle assembly 16.

Figure 8:
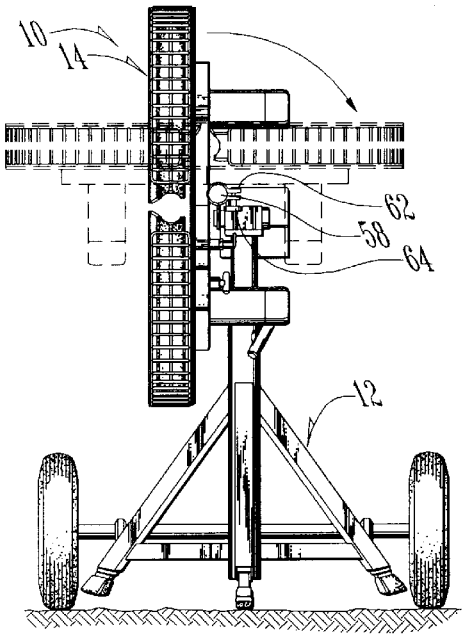
FIG. 8 is a front elevational view of the pitching machine showing adjustment of the pitching heads from a vertical orientation to a horizontal orientation.
Figure 9:
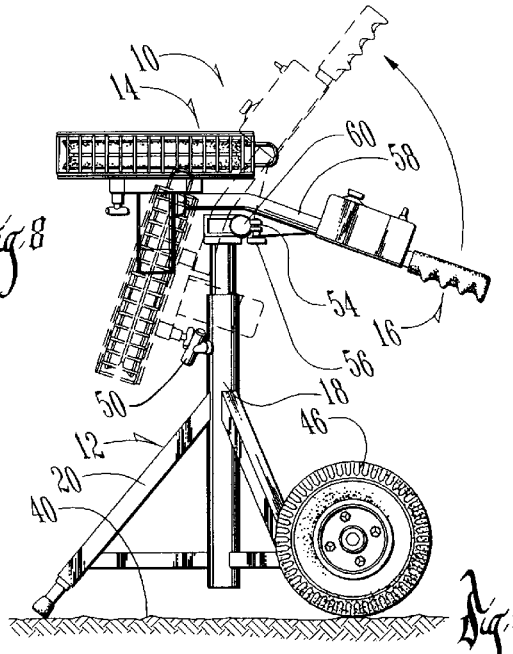
FIG. 9 is a side elevational view of the pitching machine showing adjustment of the angle of elevation of the pitching heads.

FIG. 8 shows how head assembly 14 may be pivoted from the horizontal position shown in solid lines in FIG. 9 to a vertical position shown in solid lines in FIG. 8. This is accomplished by loosening head knob 64 on second bracket 62 to permit rotation of head assembly 14 on the forward end of handle 58. Knob 64 is then tightened in the desired position. It should be noted that head assembly 14 may be secured in any position between horizontal and vertical, as desired. Similarly, the angle of elevation of the head assembly 14 may be adjusted by pivoting handle assembly 58 on shaft 60, as shown in FIG. 9. Vertical height of the head assembly 14 may be easily accomplished without changing either the angle of elevation or the orientation of the head assembly, by loosening locking device 50 and raising piston 48 within mast 18. Preferably, lower legs 30 are extended and secured utilizing locking pins 34, as shown in FIG. 1, to secure the ball pitching machine above the ground and off of wheels 46.

Whereas the invention has been shown and described in connection with the preferred embodiment thereof, many modifications, substitutions and additions may be made which are within the intended broad scope of the appended claims.

We claim:

1. A ball machine, comprising:

a head assembly with means for ejecting a ball therefrom;

said head assembly operably mounted on a vertically extensible piston, for selective vertical adjustment of the head assembly;

said piston operably connected to a base assembly, the base assembly supporting the piston in a generally upright orientation;

said piston having a mounting bracket on an upper end thereof, selectively rotatively connected to a shaft on an elongated handle with a forward and rearward end for selective rotation about a longitudinal axis of the shaft, said shaft oriented orthogonal to a longitudinal axis of the forward end of the handle and orthogonal to a longitudinal axis of the piston.

2. The pitching machine of claim 1, wherein said base assembly includes an upright, hollow tubular mast; said piston slidably journaled within the mast, and further comprising a locking device on the mast for selectively securing the piston at a selected vertical position within the mast.

3. The pitching machine of claim 2, wherein said head assembly includes a mounting bracket thereon selectively rotatably connected to a forward end of the said handle for selective rotation about a longitudinal axis of the forward end of the handle, said handle connected to the piston for vertical movement therewith.

4. The pitching machine of claim 2, wherein said head assembly includes:

first and second generally coplanar pitching wheels rotatably mounted on first and second generally coplanar support plates;

a first motor mounted on the first support plate and operable to rotate the first wheel in a first direction;

a second motor mounted on the second support plate and operable to rotate the second wheel in a direction opposite the first wheel; and means selectively, adjustable connecting the first and second support plates, permitting selective movement of the wheels towards and away from each other while maintaining the support plates in coplanar relationship.

5. The pitching machine of claim 4, further comprising lock means for selectively locking the pitching wheel support plates in position relative to one another.

6. The pitching machine of claim 5, further comprising:

a first shroud substantially enclosing the first wheel;

a second shroud substantially enclosing the second wheel;

an exit opening in the first and second shrouds located along line generally centered between the pitching wheels and coplanar therewith and forwardly of the wheels;

an entrance opening in the first and second shrouds located along the same line as the exit opening and rearwardly of the wheels; and a feeder tube having a first portion mounted on the first shroud and projecting rearwardly from the entrance opening, and a second portion mounted on the second shroud and projecting rearwardly from the entrance opening;

said feeder tube first and second portions spaced apart a distance to prevent entry of a ball having a diameter too large for the distance between the pitching wheels.

7. The pitching machine of claim 6, wherein said base assembly includes a plurality of legs extending downwardly and radially outwardly from the mast to support the mast above a ground surface.

8. The pitching machine of claim 7, wherein said legs are selectively length-extensible, to permit selective adjustment of the distance of the mast above the ground.

9. The pitching machine of claim 8, further comprising a generally horizontally oriented axle mounted between a pair of said legs, said axle having wheels rotatably mounted on opposing ends thereof and located to engage the ground when the extensible legs are retracted.

10. The pitching machine of claim 1, wherein said head assembly includes a mounting bracket thereon selectively rotatably connected to a forward end of an elongated handle for selective rotation about a longitudinal axis of the forward end of the handle, said handle connected to the piston for vertical movement therewith.

11. The pitching machine of claim 10, wherein said piston has a mounting bracket on an upper end thereof, selectively rotatably connected to a shaft on the handle for selective rotation about a longitudinal axis of the shaft, said shaft oriented orthogonal to the longitudinal axis of the forward end of the handle and orthogonal to a longitudinal axis of the mast.

* * * * *